US011172764B2

(12) United States Patent
Tackaberry et al.

(10) Patent No.: US 11,172,764 B2
(45) Date of Patent: Nov. 16, 2021

(54) FEATURE HIGH CHAIR

(71) Applicant: Skip Hop, Inc., New York, NY (US)

(72) Inventors: Jillian K. Tackaberry, Chicago, IL (US); John Healy, Brooklyn, NY (US); D Matthew Puhalla, Glen Ellyn, IL (US); Benjamin Bearsch, Brooklyn, NY (US); Kyle A. Buzzard, Lombard, IL (US); Dah Rong Kao, Flushing, NY (US); Scott Harold Wilson, Chicago, IL (US)

(73) Assignee: Skip Hop, Inc., New York, NY (US)

( * ) Notice: Subject to any disclaimer, the term of this patent is extended or adjusted under 35 U.S.C. 154(b) by 0 days.

(21) Appl. No.: 16/894,135

(22) Filed: Jun. 5, 2020

(65) Prior Publication Data

US 2020/0383490 A1 Dec. 10, 2020

Related U.S. Application Data

(60) Provisional application No. 62/857,680, filed on Jun. 5, 2019.

(51) Int. Cl.

| | |
|---|---|
| ***A47C 12/02*** | (2006.01) |
| ***A47D 11/00*** | (2006.01) |
| ***A47D 1/00*** | (2006.01) |

(52) U.S. Cl.

CPC ..... *A47C 12/02* (2013.01); *A47D 1/00* (2013.01); *A47D 11/00* (2013.01)

(58) Field of Classification Search

CPC ..... A47D 11/00; A47C 12/02

See application file for complete search history.

(56) References Cited

U.S. PATENT DOCUMENTS

| | | | | |
|---|---|---|---|---|
| 1,896,451 | A | 2/1933 | Lofton | |
| 2,560,708 | A | 7/1951 | Titus | |
| 3,427,069 | A | 2/1969 | McDonald | |
| 4,258,827 | A | 3/1981 | Klose | |
| 5,951,102 | A | 9/1999 | Paulson et al. | |
| 6,050,643 | A | 4/2000 | Kain et al. | |
| 6,089,653 | A | 7/2000 | Hotaling et al. | |
| D689,292 | S | 9/2013 | Kittilsen et al. | |
| D691,381 | S | 10/2013 | Kittilsen et al. | |
| D691,383 | S | 10/2013 | Kittilsen et al. | |
| D691,819 | S | 10/2013 | Kittilsen et al. | |
| 9,161,636 | B2 * | 10/2015 | Opsvik | A47D 1/103 |
| 10,588,425 | B1 * | 3/2020 | Jordan | A47D 13/06 |
| 2013/0241248 | A1 | 9/2013 | Kostyniak et al. | |

(Continued)

FOREIGN PATENT DOCUMENTS

| | | | |
|---|---|---|---|
| CN | 2627930 | Y | 7/2004 |
| CN | 102973049 | A | 3/2013 |

(Continued)

OTHER PUBLICATIONS https://web.archive.org/web/20190614155037if_/https://www.stokke.com/USA/en-us/highchairs-1?forcelisting=true&viewall=true, Jun. 14, 2019, 39 pgs.

(Continued)

*Primary Examiner* — Sarah B McPartlin

(74) *Attorney, Agent, or Firm* — Greenberg Traurig, LLP

(57) ABSTRACT

A combination step stool and high chair includes at least a base with one or more steps and a chair that can be selectively attached to and detached from the base.

16 Claims, 11 Drawing Sheets

(56) References Cited

U.S. PATENT DOCUMENTS

| | | | | |
|---|---|---|---|---|
| 2015/0359354 | A1 | 12/2015 | Greger | |
| 2019/0231087 | A1* | 8/2019 | Dziak | A47D 1/023 |
| 2021/0037989 | A1* | 2/2021 | Rogers | A47D 1/004 |

FOREIGN PATENT DOCUMENTS

| | | | |
|---|---|---|---|
| CN | 104433506 | A | 3/2015 |
| CN | 105011628 | A | 11/2015 |
| CN | 205125708 | U | 4/2016 |
| CN | 106859138 | A | 6/2017 |
| DE | 7521841 | U | 1/1976 |
| FI | 822995 | L | 3/1984 |
| FR | 2992152 | B3 | 1/2015 |
| GB | 2086220 | A | 5/1982 |
| JP | 6-62935 | A | 3/1994 |
| JP | 6-34560 | U | 5/1994 |
| JP | 7-124040 | A | 5/1995 |
| JP | 2002-223902 | A | 8/2002 |
| JP | 2004-195022 | A | 7/2004 |
| JP | 2014-204946 | A | 10/2014 |
| WO | 9801060 | | 1/1998 |
| WO | 2011012871 | A1 | 2/2011 |
| WO | 2018113321 | A1 | 6/2018 |
| WO | 2019140475 | A1 | 7/2019 |

OTHER PUBLICATIONS

2008—Combi Hero Instruction Manual, 9 pgs.
2009—Fisher Price 3-in-1 High Chair to Booster Instructions, 8 pgs.
2010—Oxo Sprout Chair Instruction Manual, 20 pgs.
2012—Graco DuoDiner Owners Manual, 28 pgs.
2014—Graco Souffle Owners Manual, 28 pgs.
2015—Evenflo Quatore User Manual, 44 pgs.
2015—Fisher Price 4-in-1 Total Clean High Chair, 24 pgs.
2016—Keekaroo Height Right Kids Chair Manual, 6 pgs.
2017—Graco Table2Table Owners Manual, 56 pgs.
2017—Stokke Steps Baby Set User Guide, 28 pgs.

* cited by examiner

FEATURE HIGH CHAIR

CLAIM OF PRIORITY UNDER 35 U.S.C. § 119

The present application for patent claims priority to Provisional Application No. 62/857,680 entitled "FEATURE HIGH CHAIR" filed Jun. 5, 2019, and assigned to the assignee hereof, and hereby expressly incorporated by reference herein.

BACKGROUND

Conventionally, high chairs have been relatively fixed and single-purpose products. They are used while a child is too small or unable to sit at a dinner table in a normal chair. After that point, high chairs are no longer of use and are sold, thrown away, or put into storage until the family has another child.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

A first aspect is directed to a combination high chair and step stool. The combination includes a base. The base includes a first pair of legs, a second pair of legs, a first step disposed at a first elevation between at least one of the first pair of legs and at least one of the second pair of legs, a second step disposed at a second elevation between the at least one of the first pair of legs and the at least one of the second pair of legs, a first bracket portion, and a second bracket portion. The combination also includes a seat. The seat includes a first mounting member configured to be selectively attached to the first bracket portion and a second mounting member configured to be selectively attached to the second bracket portion.

The combination may further include a handrail, which may include a bar, a third mounting member disposed at a first end of the bar and configured to be selectively attached to the first bracket, and a fourth mounting member disposed at a second end of the bar and configured to be selectively attached to the second bracket.

The first bracket portion may include a central guide; the third mounting member comprises a vertical channel; and the central guide may be inserted into the vertical channel when the third mounting member is attached to the first bracket portion.

The third mounting member may also include a flexible tab for selectively locking the third mounting member to the first bracket portion.

The bar may include a horizontal portion disposed between two vertical portions.

The combination may further a first hinge pivotally joining the first pair of legs and comprising the first bracket portion and a second hinge pivotally joining the second pair of legs and comprising the second bracket portion.

In some instances, when the combination is in a first configuration, the first pair of legs extend downward at a first angle relative to each other and the second pair of legs extend downward at the first angle relative to each other, and when the combination is in a second configuration, the first pair of legs extend downward at a second angle relative to each other and the second pair of legs extend downward at the second angle, the second angle being less than the first angle.

The first and second pairs of legs may each include a front leg and a rear leg, and the combination may further include a front cross bar extending between the front legs of the first and second pairs of legs and a rear cross bar extending between the rear legs of the first and second pairs of legs. The second step may extend between and be supported by the front and rear cross bars when the combination is in the first configuration, and the second step may be supported by the rear cross bar and not the front cross bar when the combination is in the second configuration.

The second step may include a button that, when depressed, disengages the second step from the front cross bar.

The second step may include an elongate channel through which the rear cross bar passes and along which the rear cross bar is permitted to travel when the combination is in the second configuration.

The first hinge may include a button that, when depressed, allows the first pair of legs to pivot relative to each other, and the button may be biased outward so as to prevent rotation of the first pair or legs relative to each other.

The second elevation may be higher than the first elevation, and the second step may include a platform spanning at least between front legs of the first and second pairs of legs and rear legs of the first and second pairs of legs.

A second aspect is directed to a combination high chair and step stool for supporting a child above a surface. The combination includes a step stool portion. The step stool portion includes a first step disposed at a first elevation relative to the surface and capable of supporting the child, a second step disposed at a second elevation relative to the surface and capable of supporting the child, and a bracket. The combination further includes a chair portion. The chair portion includes a seat, a back, and a mounting member configured to be selectively and releasably attached to the bracket.

The bracket may include a central guide; the mounting member may include a vertical channel; and the central guide may be inserted into the vertical channel when the mounting member is attached to the bracket.

The central guide may include a depression disposed on an outward face thereof; the mounting member may include a projection disposed within the vertical channel; and the projection may be inserted into the depression when the mounting member is attached to the bracket to thereby lock the mounting member and the bracket together.

The bracket may include a plurality of depressions disposed at varying positions on an outward face thereof, wherein the projection can be selectively inserted into any one of the plurality of depressions to enable the height of the chair portion relative to the step stool portion to be adjusted.

The projection may be retractable into the mounting member and out of the depression to permit the mounting member to move relative to the bracket.

The mounting member may include a button that, when depressed, causes the projection to retract into the mounting member.

The combination may further include a tray that is selectively attachable to the chair portion.

A third aspect is directed to a system for a combination high chair and step stool. The system includes a base, a chair and a handrail. The base includes a first pair of legs, a first hinge pivotally joining the first pair of legs and comprising a first bracket, a second pair of legs, a second hinge pivotally joining the second pair of legs and comprising a second bracket, a first step disposed at a first elevation between at least one of the first pair of legs and at least one of the second pair of legs, and a second step disposed at a second elevation between the at least one of the first pair of legs and the at least one of the second pair of legs. The chair includes a seat, a back, a first mounting member disposed at a first side of the chair and configured to be selectively attached to the first bracket, and a second mounting member disposed at a second side of the chair and configured to be selectively attached to the second bracket. The handrail includes a bar, a third mounting member disposed at a first end of the bar and configured to be selectively attached to the first bracket, and a fourth mounting member disposed at a second end of the bar and configured to be selectively attached to the second bracket. The chair and the handrail are interchangeably attachable to the base.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Various embodiments of the present invention relate to a high chair that can be converted to a stepstool when a child is ready to stand and help in the kitchen. Such embodiments may implement the convertibility with a base with one or more steps, where the base may be interchangeably coupled with a chair or a hand rail. Furthermore, the convertible highchair can fold for easy storage in either the highchair or step stool configuration.

Figure 1:
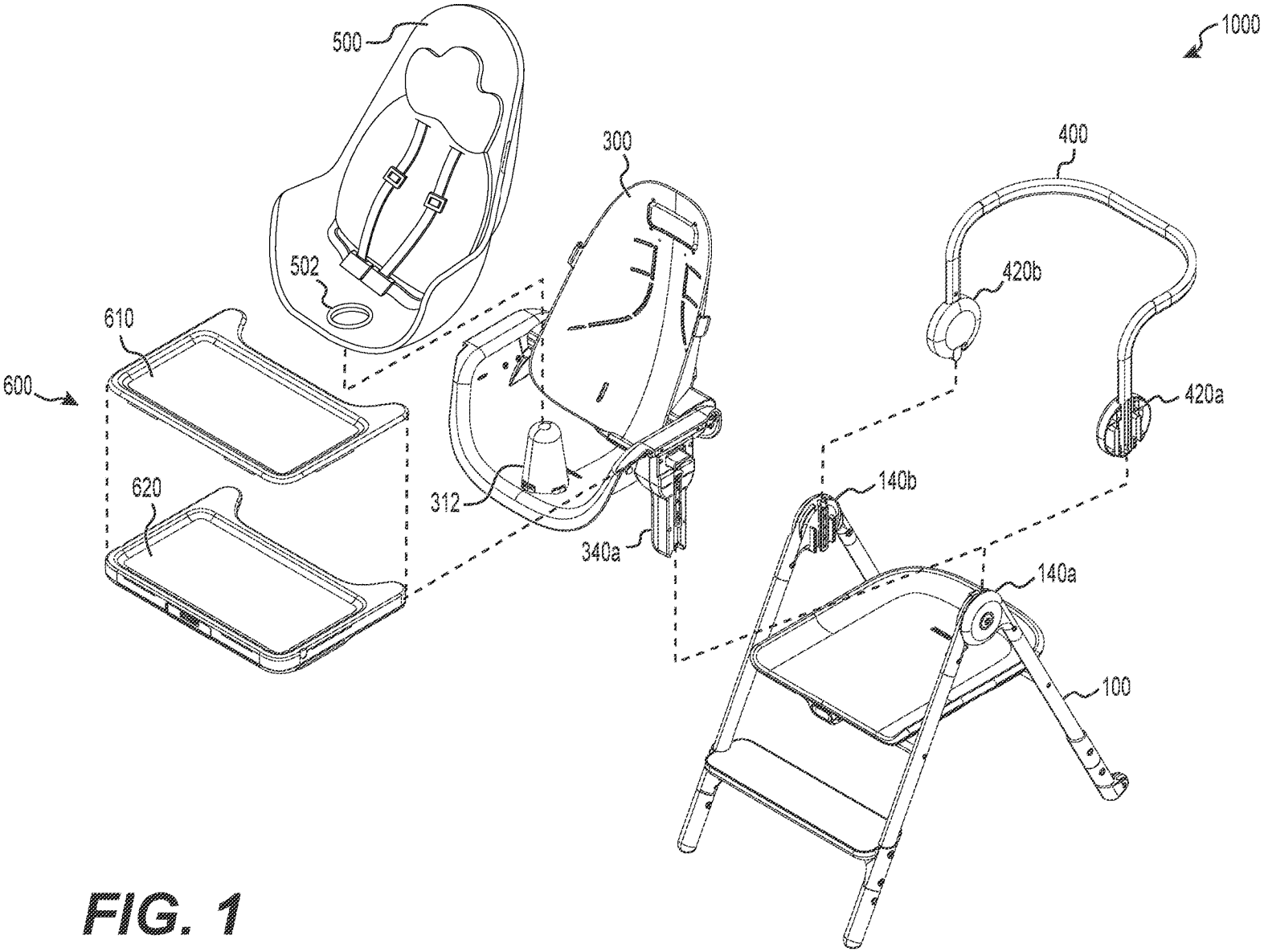
FIG. 1 is an exploded view of a high chair system, in accordance with various embodiments of the present invention.

FIG. 1 shows an exploded view of a high chair system 1000, in accordance with various embodiments of the present invention. The high chair system 1000 includes a base 100. The base 100 includes first and second bracket portions 140*a*, 140*b* for coupling to various other parts. The first and second bracket portions 140*a*, 140*b* also include hinges for folding the base 100.

The high chair system also includes a chair 300 and a handrail 400. The chair 300 includes first and second mounting assemblies 340*a*, 340*b* (the latter shown in FIG. 12) for respectively coupling with the first and second bracket portions 140*a*, 140*b* of the base 100. Similarly, the handrail 400 includes first and second mounting members 420*a*, 420*b* for respectively coupling with the first and second bracket portions 140*a*, 140*b* of the base 100. In some embodiments, the chair 300 and the handrail 400 may simultaneously be coupled to separate portions of the bracket portions 140*a*, 140*b*, e.g., upper and lower portions of the bracket portions 140*a*, 140*b* or inner and outer sides of the bracket portions 140*a*, 140*b*. The high chair system 1000 may also include a fabric and/or padded insert 500 for the seat 300. In embodiments where the seat 300 includes a hard restraint 312, the insert 500 may include a complementary hole 502 through which the hard restraint 312 may pass.

The high chair system 1000 may also a tray 600, which may include a lower tray portion 620 and an upper tray portion 610. The lower tray portion 620 may be selectively attachable to the chair 300, and the upper tray portion 610 may be selectively attachable to the lower tray portion 620, e.g., for easy cleaning.

Figure 2:
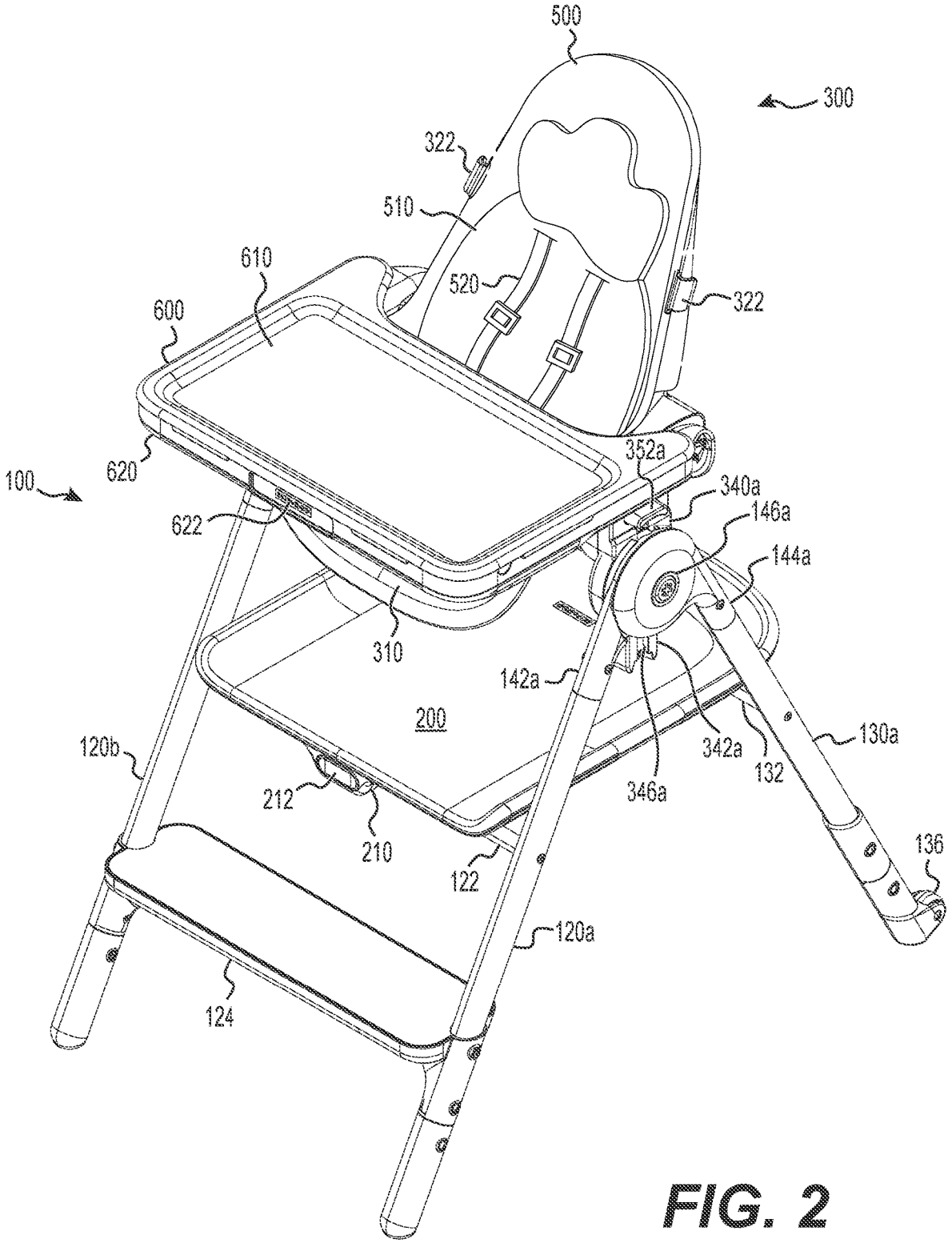
FIG. 2 is an upper perspective view of the high chair system in the form of a high chair, in accordance with various embodiments of the present invention.
Figure 3:
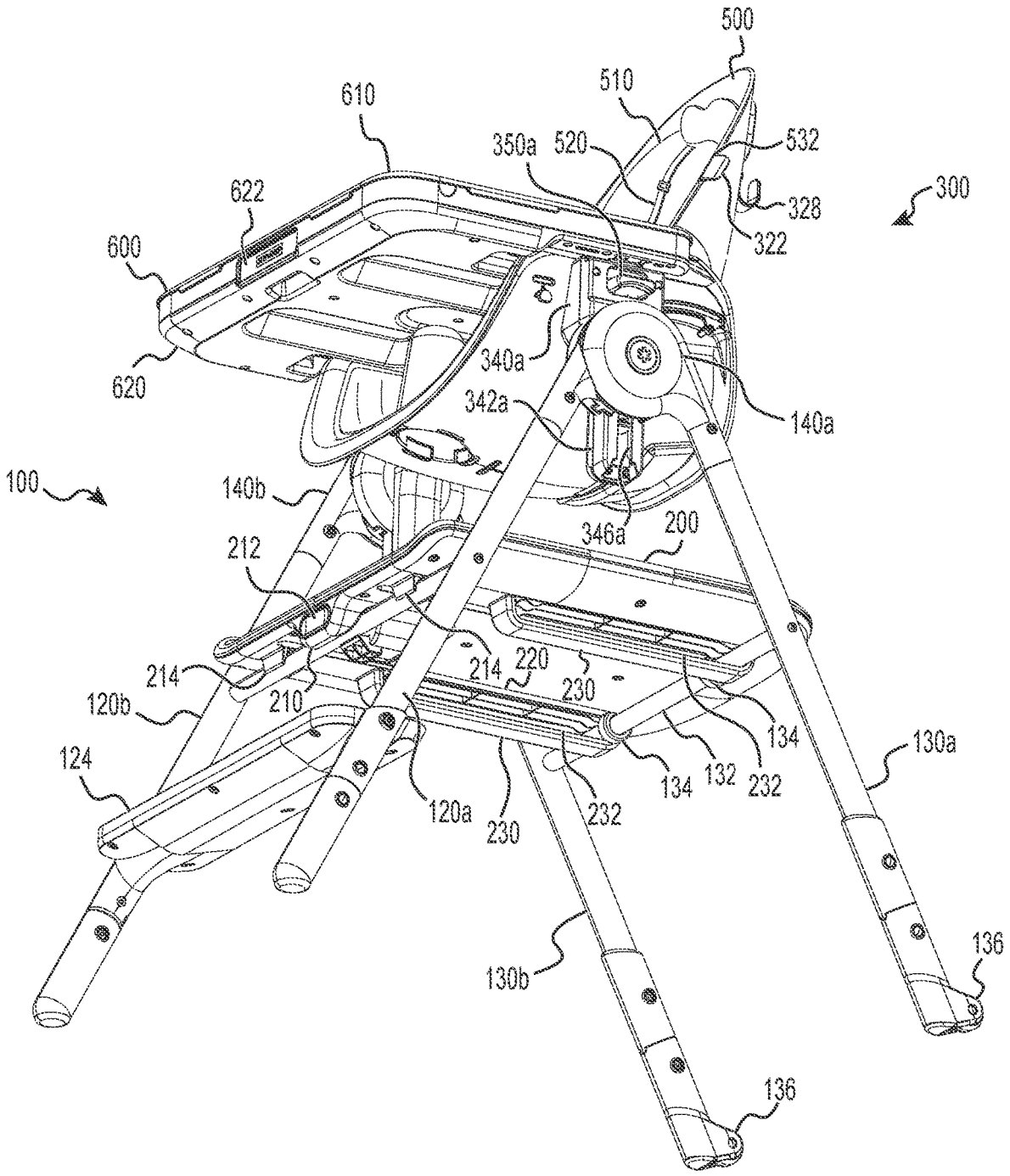
FIG. 3 is a lower perspective view of the high chair system in the form of a high chair, in accordance with various embodiments of the present invention.
Figure 4:
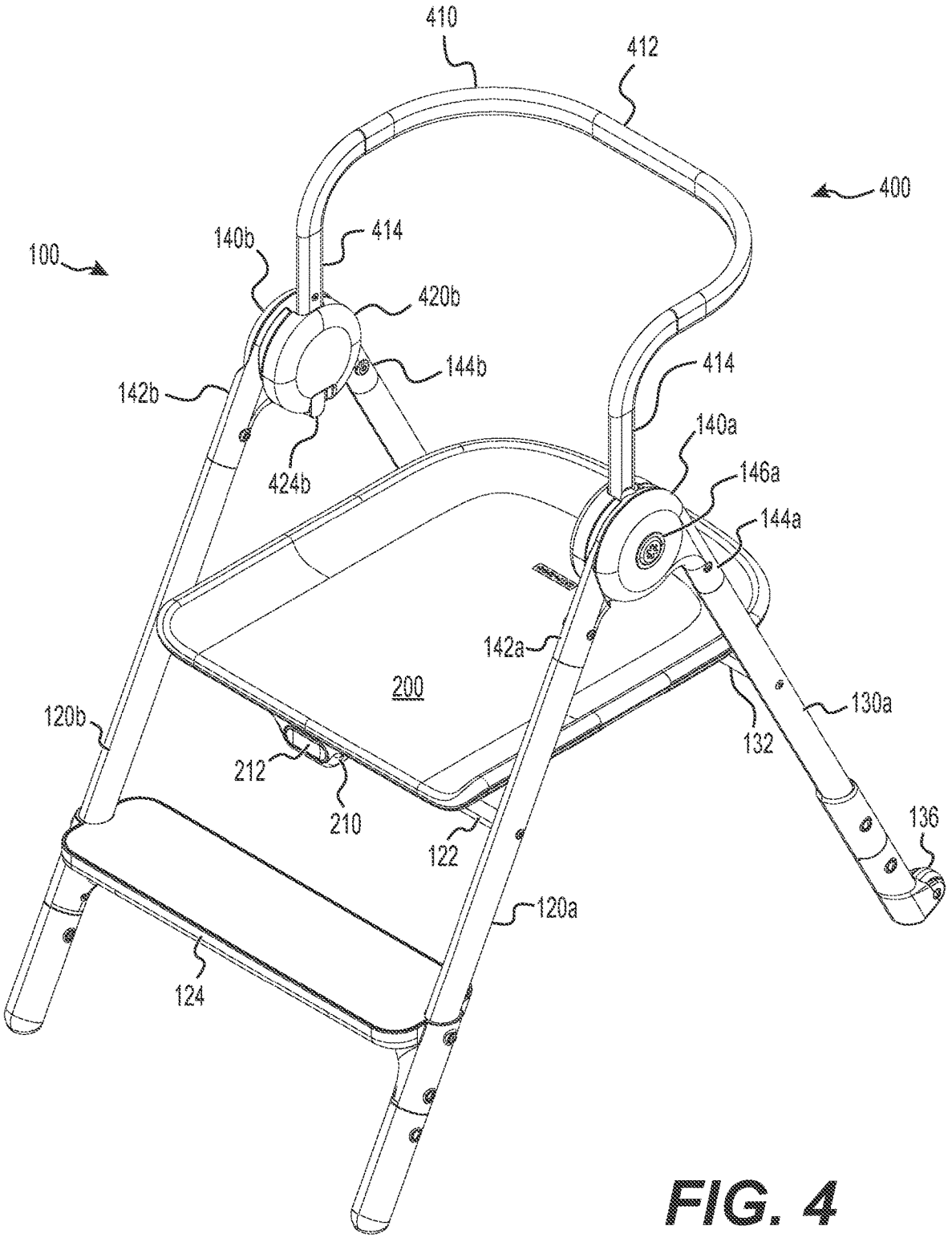
FIG. 4 is a perspective view of the high chair system in the form of a step stool, in accordance with various embodiments of the present invention.

FIGS. 2 and 3 show upper and lower perspective views, respectively, of the high chair system 1000 in the form of a high chair with the chair 300 attached to the base 100, in accordance with various embodiments of the present invention. The base 100 includes a first pair of legs 120*a*, 130*a*, which are pivotally connected at an upper end of each leg 120*a*, 130*a* by a first hinge portion 140*a*, and a second pair of legs 120*b*, 130*b*, which are likewise pivotally connected at an upper end of each leg 120*b*, 130*b* by a second hinge portion 140*b*. A front cross bar 122 extends between the front legs 120*a*, 120*b* and a rear cross bar 132 extends between the rear legs 130*a*, 130*b*. Furthermore, each of the rear legs 130*a*, 130*b* may include a wheel 136 at the end of the legs 130*a*, 130*b*. Further still, a first step 124 extends between the two front legs 120*a*, 120*b*, and a platform 200 (or second step) extends between both the two front legs 120*a*, 120*b* and the two rear legs 130*a*, 130*b*, which are useful when the combination is configured as a step stool, as shown in FIG. 4. The platform 200 also extends between and is supported by the front cross bar 122 and the rear cross bar 132. In particular, as shown in FIG. 3, the platform 200 includes a latching portion 210 which is configured to selectively secure the platform 200 to the front cross bar 122. The platform 200 may also include a release button 212, which when pressed may cause the latching portion 210 to release the front cross bar 122. The platform 200 may further include one or more alignment guides 214 to further aid in aligning and stabilizing the front of the platform 200 with the front cross bar 122. The platform may also include one or more downwardly projecting rails 230 which extend along the length of the platform 200 and define one or more channels 232 through which the rear cross bar 132 extends. As such, the platform 200 can rotate about the rear cross bar 132 and slide along the rear cross bar 132 along the length of the channels 232. The base 100 may further include one or more guide cylinders 134 disposed at one or more locations along the length of the rear cross bar 132, and the platform may include complementary grooves 220 running substantially parallel to the rails. The guide cylinders 134 may partially fit within the grooves 220, such that the guide cylinders 134 help maintain the lateral position of the platform 200 relative to the rear cross bar 132.

FIG. 4 is a perspective view of the high chair system 1000 in the form of a step stool with the handrail 400 attached to the base 100, in accordance with various embodiments of the present invention. As shown, the mounting members 420*a*, 420*b* of the handrail 400 are coupled with the bracket portions 140*a*, 140*b* of the base 100, as discussed further below. The mounting members 420*a*, 420*b* may include tabs 424*b*, discussed in more detail below, for selectively releasing the handrail 400 from the base 100. In the illustrated embodiment, the handrail 400 includes a bar 410 with a horizontal portion 412 and two vertical portions 414. On each of the two vertical portions 414 are the mounting members 420*a*, 420*b*, respectively.

Figure 5:
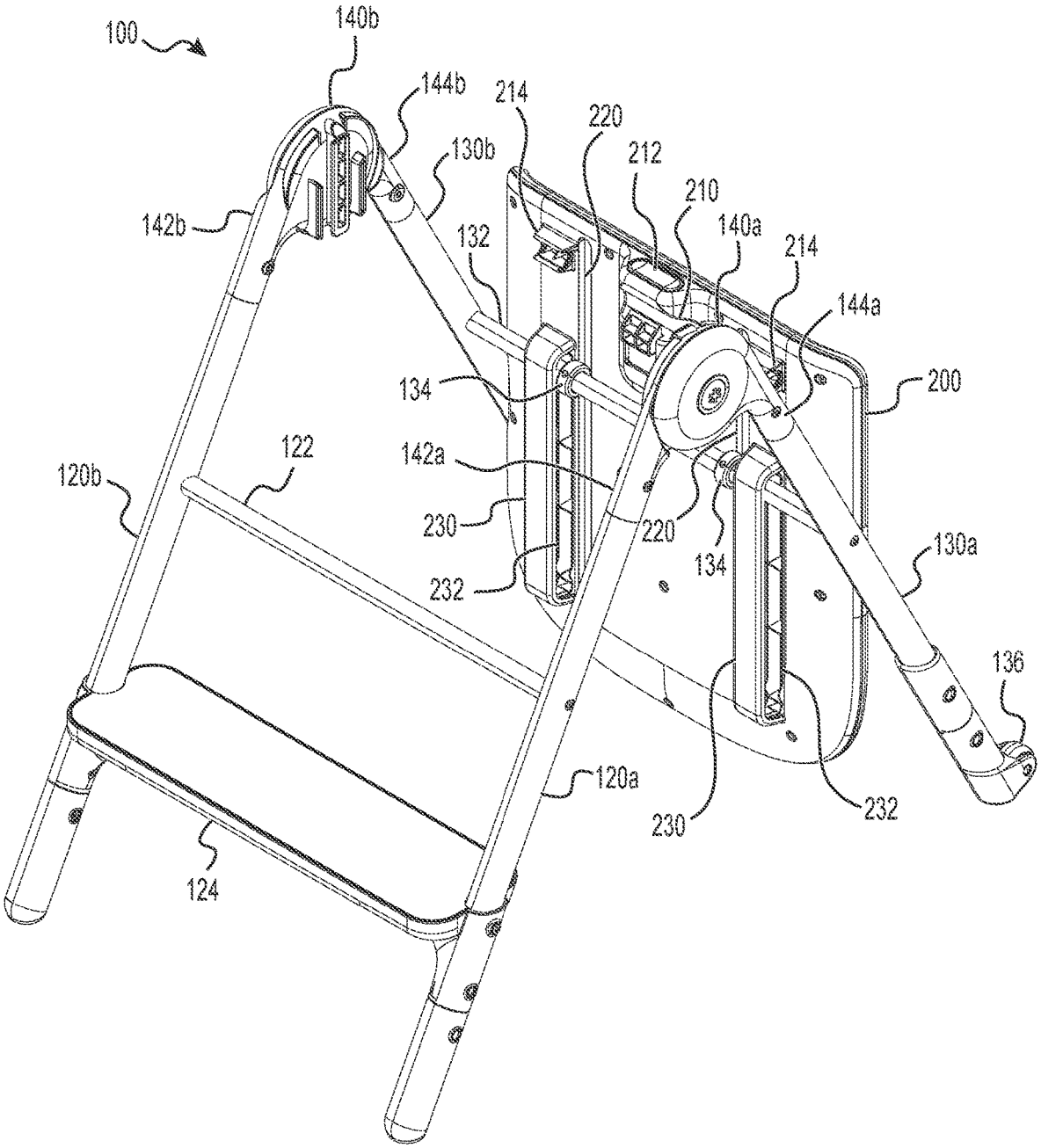
FIG. 5 is a perspective view of a base of the high chair system, in accordance with various embodiments of the present invention.

In each of forms shown in FIGS. 1-4, the base 100 is in a first (e.g., unfolded) configuration in which the front legs 120*a*, 120*b* and the rear legs 130*a*, 130*b* extend downward at a first angle that allows the base 100 to stably support the high chair system 1000 system when configured as either the highchair or the step stool. However, in some embodiments, the base 100 may be foldable. FIG. 5 illustrates the base 100 in isolation with latching portion 210 of the platform 200 released from the front cross bar 122, the platform 200 rotated about the rear cross bar 132, and the platform 200 slid along the rear cross bar 132 into a downward, stowed position. Such may be a first step in folding the base 100.

Figure 6:
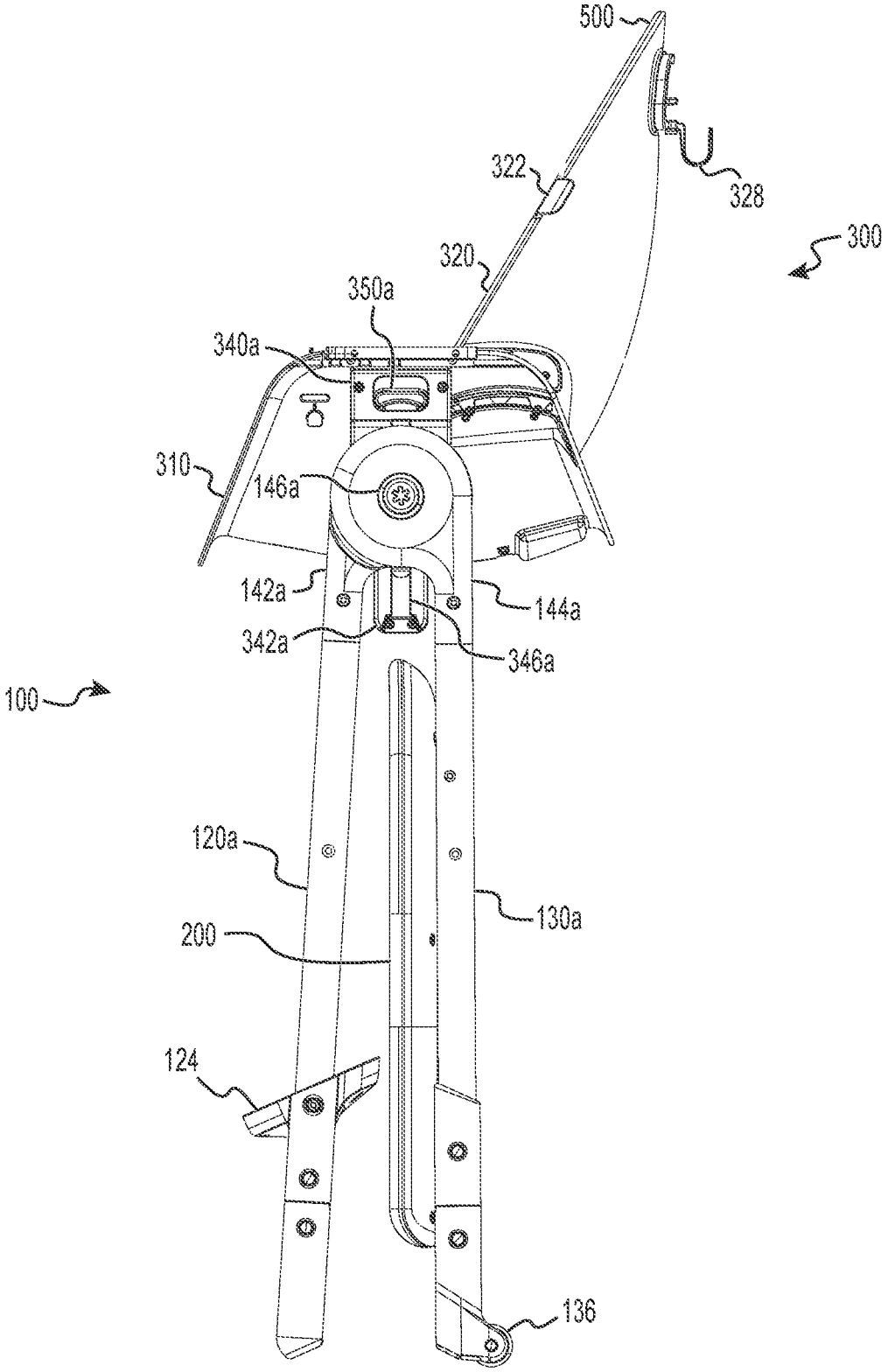
FIG. 6 is a side view of the high chair system in a folded configuration, in accordance with various embodiments of the present invention.

FIG. 6 illustrates a folded configuration of the base 100 in which the front legs 120*a*, 120*b* and the rear legs 130*a*, 130*b* extend downward at a second angle that is less than the first angle. In this second configuration of the base 100, the platform 200 has been detached from the front cross bar 122 and moved relative to the rear cross bar 132. To arrive at the configuration shown in FIG. 6, the front legs 120*a*, 120*b* are pivoted relative to the rear legs 130*a*, 130*b* by way of the hinges of the bracket portions 140*a*, 140*b* to bring the base 100 into the second (e.g., folded) configuration.

Figure 7:
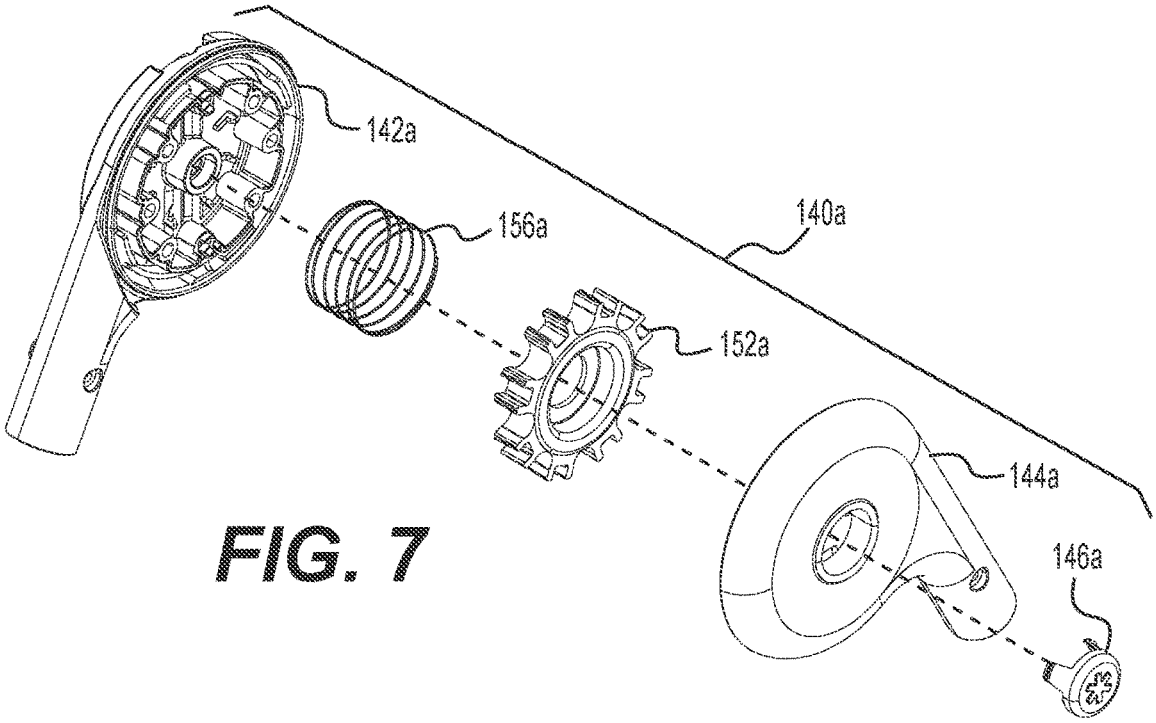
FIG. 7 is an exploded view a first bracket portion of the base of the high chair system, in accordance with various embodiments of the present invention.
Figure 8:
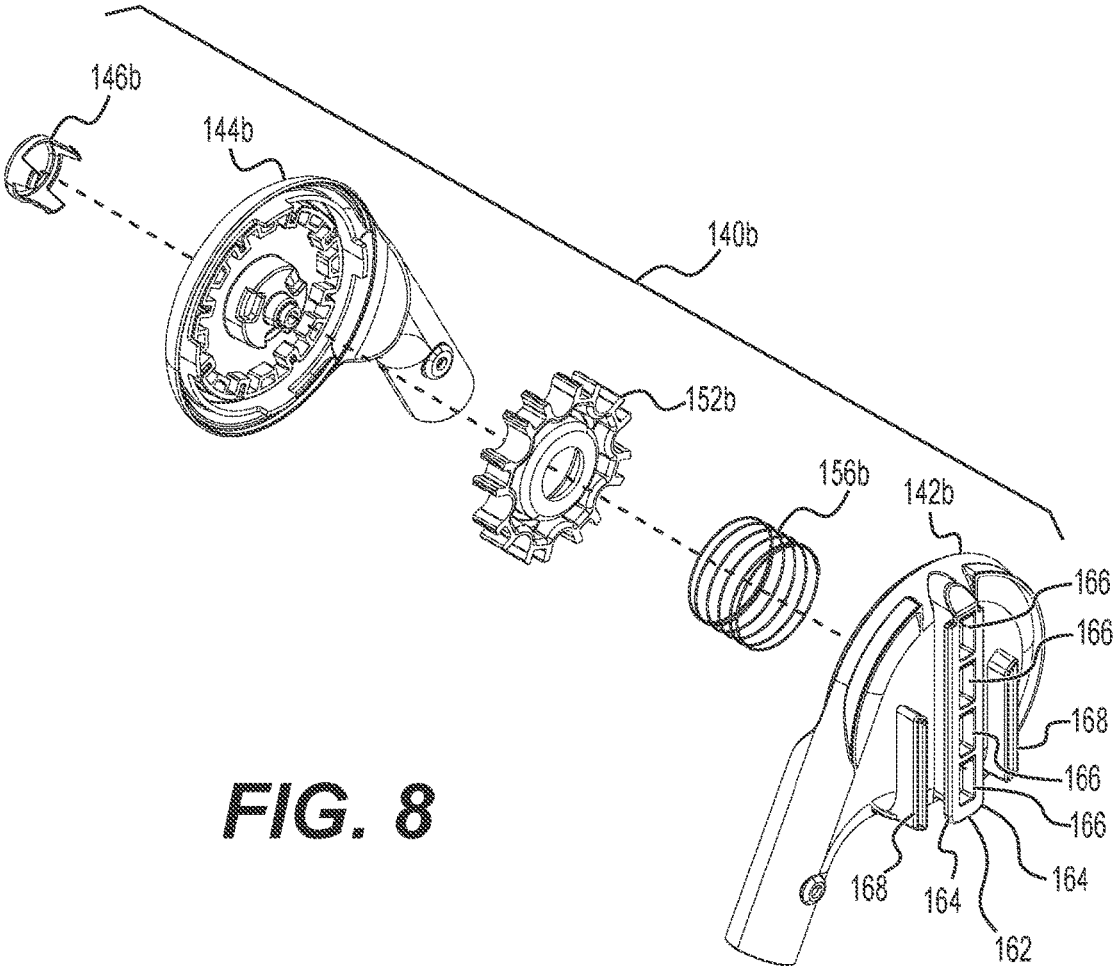
FIG. 8 is an exploded view of a second bracket portion of the base of the high chair system, in accordance with various embodiments of the present invention.

FIGS. 7 and 8 are exploded views of the first and second bracket portions 140*a*, 140*b*, respectively, in accordance with various embodiments of the present invention. The construction of the two bracket portions 140*a*, 140*b* is substantially identical except mirrored. As such, any details shown of one bracket portion should be understood to apply similarly to the other. The bracket portions 140*a*, 140*b* selectively lock the front legs 120*a*, 120*b* and the rear legs 130*a*, 130*b* at the first angle (FIGS. 1-5) as well as at the second angle (FIG. 6). In particular, first members 142*a*, 142*b* of the bracket portions 140*a*, 140*b* are connected to the front legs 120*a*, 120*b*, and second members 144*a*, 144*b* of the bracket portions 140*a*, 140*b* are connected to the rear legs 130*a*, 130*b*. The first and second members 142*a*, 144*a* of the first bracket portion 140*a* are pivotally connected to each other, as are the first and second members 142*b*, 144*b* of the second bracket portion. The bracket portions 140*a*, 140*b* also include release buttons 146*a*, 146*b*, which, when depressed, allow the second members 144*a*, 144*b* to pivot relative to the first members 142*a*, 142*b*. In particular, pushing the buttons 146*a*, 146*b* moves knuckle lock plates 152*a*, 152*b* so as to disengage from the second members 144*a*, 144*b*, with springs 156*a*, 156*b* that bias the knuckle lock plates 152*a*, 152*b* and the button 146*a*, 146*b* outward into the locking position.

FIG. 8 also shows that the second bracket portion 140*b* includes on an inner face a central guide 162 with side guides 168 on either side of the central guide 162. The central guide 162 has a substantially T-shaped cross section with flanges 164 running along the length of the central guide 162. The central guide 162 also defines a plurality of (e.g., four) depressions 166.

Figure 9:
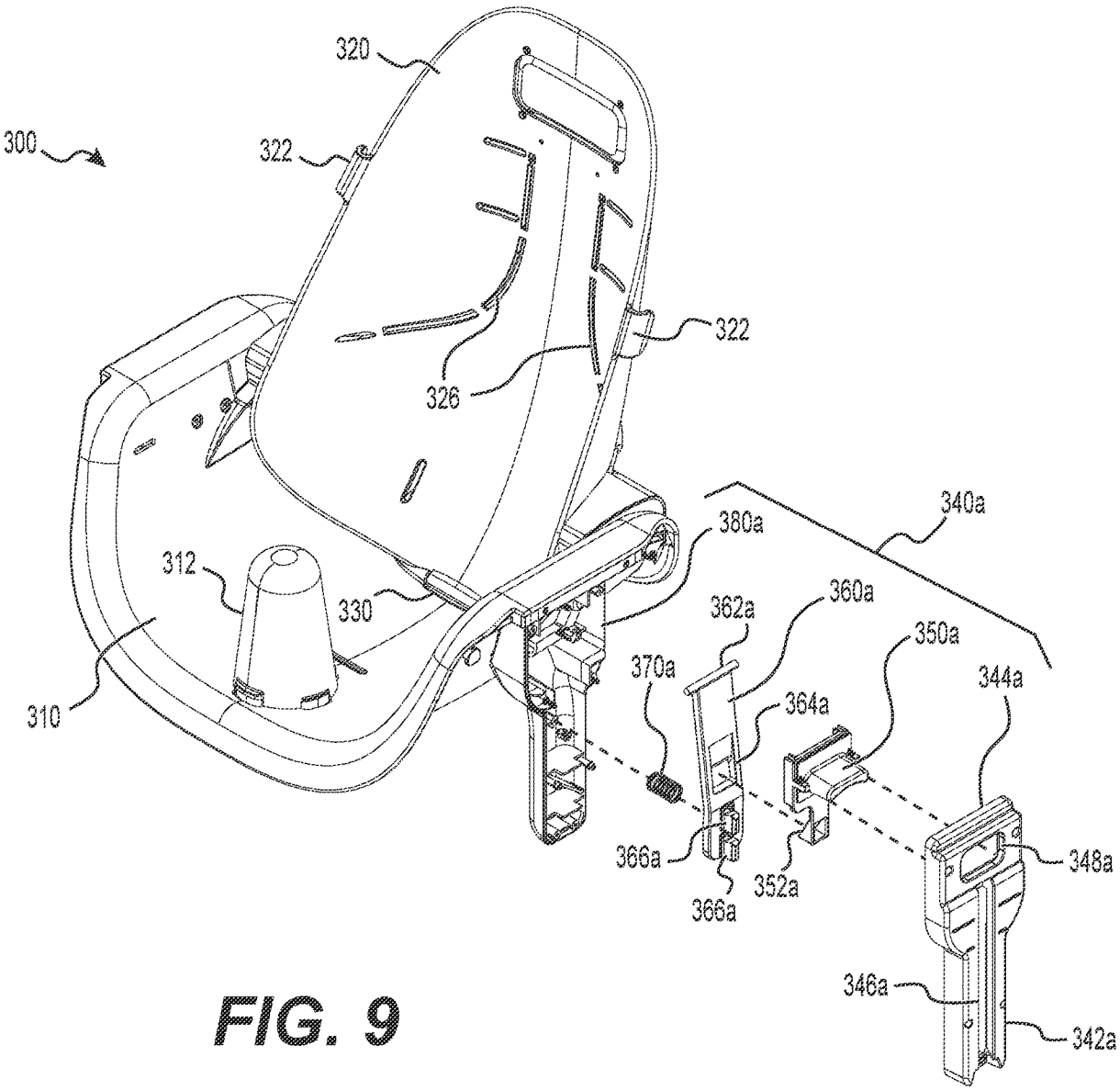
FIG. 9 illustrates the chair of the high chair system in isolation, with the insert removed to show the underlying structure, as well as a partial exploded view of a mounting assembly, in accordance with various embodiments of the present invention.

FIG. 9 illustrates the chair 300 in isolation with the insert 500 removed to show the underlying structure, as well as a partial exploded view of the mounting assembly 340*a*, in accordance with various embodiments of the present invention. The chair 300 includes a seat 310 and a back 320 extending upward from the rear end of the seat 310. The seat 310 and back 320 may be coupled via a hinge 330, so that the seat 300 may be adjustable to a reclined position, e.g., to feed younger infants. The back 320 may include a hook 322 on each side of the back 320, which allow for the straps 520 of a harness to be temporarily secured to the hooks 322 so they will not interfere when placing a child into the chair 300. As alternatives to the hooks 322, the chair 300 may instead include magnets, hook and loop fasteners or any other device to temporarily secure the straps 520. The back 320 may also include one or vents 326 to permit breathability of the insert 500. The chair 300 also includes mounting assemblies 340*a*, 340*b* that engage the bracket portions 140*a*, 140*b* of the base 100 to allow the chair 300 to be attached and removed from the base 100, as well as adjust the height of the chair 300 relative to the base 100.

Although FIG. 9 only shows one mounting assembly 340*a*, the construction of the two mounting assemblies 340*a*, 340*b* is substantially identical except mirrored. As such, any details shown of one assembly should be understood to apply similarly to the other assembly. The first mounting assembly 340*a* includes an outer housing 344*a* and an inner housing 380*a*. The outer housing 344*a* includes a vertical shaft 342*a* that further includes a T-shaped channel 346*a*. In operation, the central guide 162 of the first bracket assembly 140*a* is accepted within this channel 346*a* while each of the side guides 168 of the first bracket assembly 140*a* are positioned on either side of the vertical shaft 342*a*, thus ensuring proper alignment of the chair 300 relative to the base 100. The mounting assembly 340*a* also includes a latching member 360*a*, which pivotally connects into the inner housing 380*a* at a hinge portion 362*a*. The locking member 362*a* is biased outward by a spring 370*a* and includes one or more projections 366*a* that protrude out into the channel 346*a* when the mounting assembly 340*a* is assembled. The projections 366*a* are configured to engage the depressions 166 on the central guide 162 of the first bracket portion 140*a*. As such, depending on which depressions 166 are engaged by the projections 366*a*, the chair 300 can be adjusted to a variety of height positions. To this end, the mounting assembly 230*a* further includes a release button 350*a*, which includes an inclined surface that interfaces with an aperture 364*a* of the latching member 360*a*. When the release button 350*a* is pulled upward, the inclined surface 352*a* pushes against a corresponding inclined surface of the latching member 360*a*, thereby translating the upward movement of the release button 350*a* into an inward movement of the latching member 360*a*, causing the projections 366*a* to recede into the mounting assembly 340*a*, allowing the vertical shaft 342*a* to slide freely along the central guide 162 of the first bracket portion 140*a*.

Figure 10:
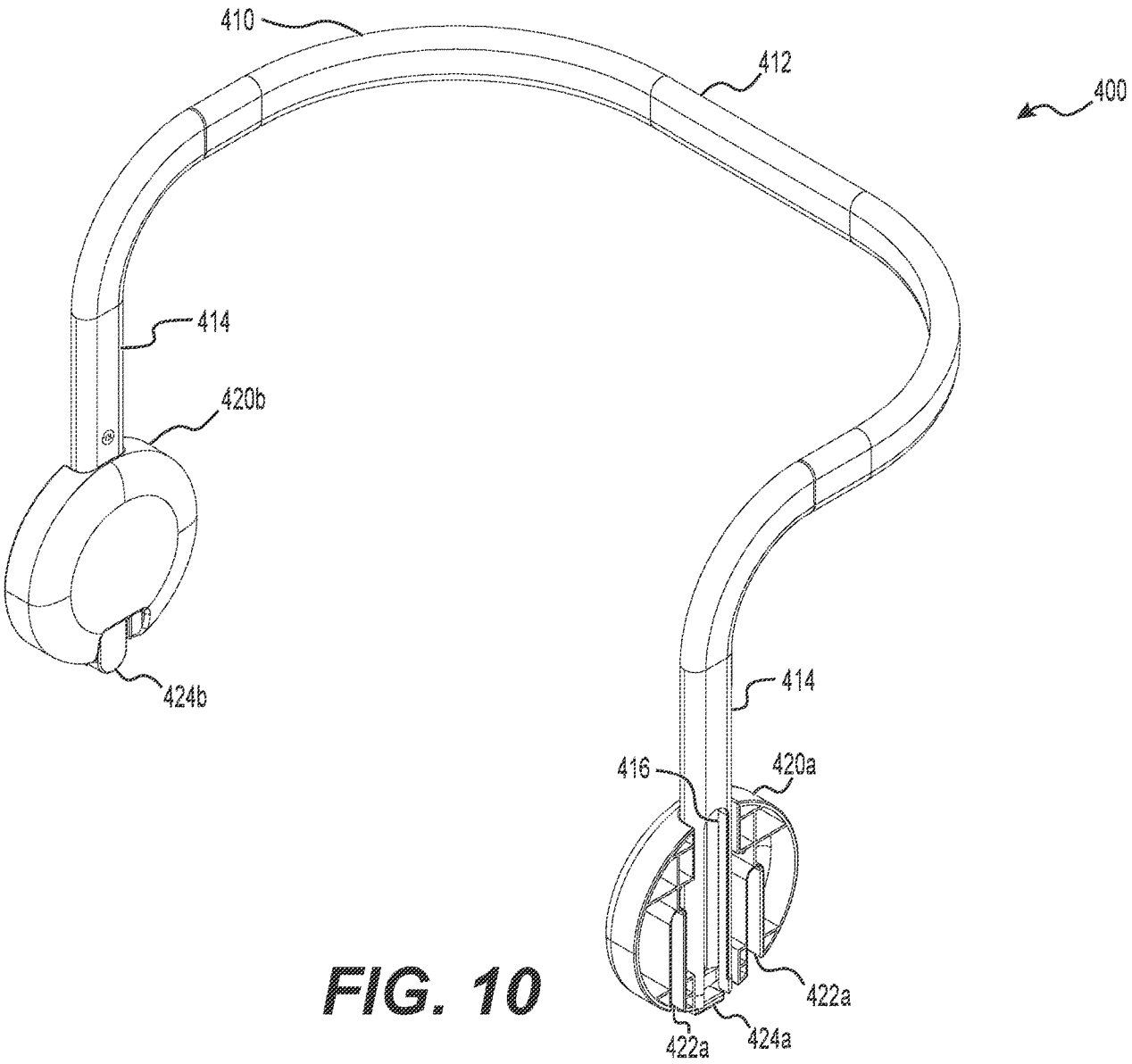
FIG. 10 shows a handrail of a high chair system in isolation, in accordance with various embodiments of the present invention.

FIG. 10 shows the handrail 400 in isolation, in accordance with various embodiments of the present invention. FIG. 10 also shows the first mounting member 420*a* in detail. The construction of the two mounting members 420*a*, 420*b* is substantially identical except mirrored. As such, any details shown of one mounting member should be understood to apply similarly to the other mounting member. The vertical portion 414 of the bar 410 defines a T-shaped channel 416 that is open to the end of the vertical portion 414 of the bar 410, while the first mounting member 420*a* defines two side channels 422*a*. In operation, the central guide 162 of the first bracket portion 140*a* is accepted within the channel 416 in the vertical portion 414 of the bar 410 and the two side guides 168 of the bracket portion 140*a* are accepted within the two side channels 422*a*, thus ensuring proper alignment of the handrail 400 relative to the base 100. A tab 424*a* of the first mounting member 420*a* is constructed of a flexible material which allows the tab 424*a* to bend out of the way while the central guide 162 of the first bracket portion 140*a* is advanced into the channel 416 but to return to place to secure the handrail 400 in place. Removal of the handrail 400 requires first pulling this tab 424*a* outward and then sliding the handrail 400 upward to remove the central guide 162 of the first actuator 130*a* from the channel 416.

Figure 11:
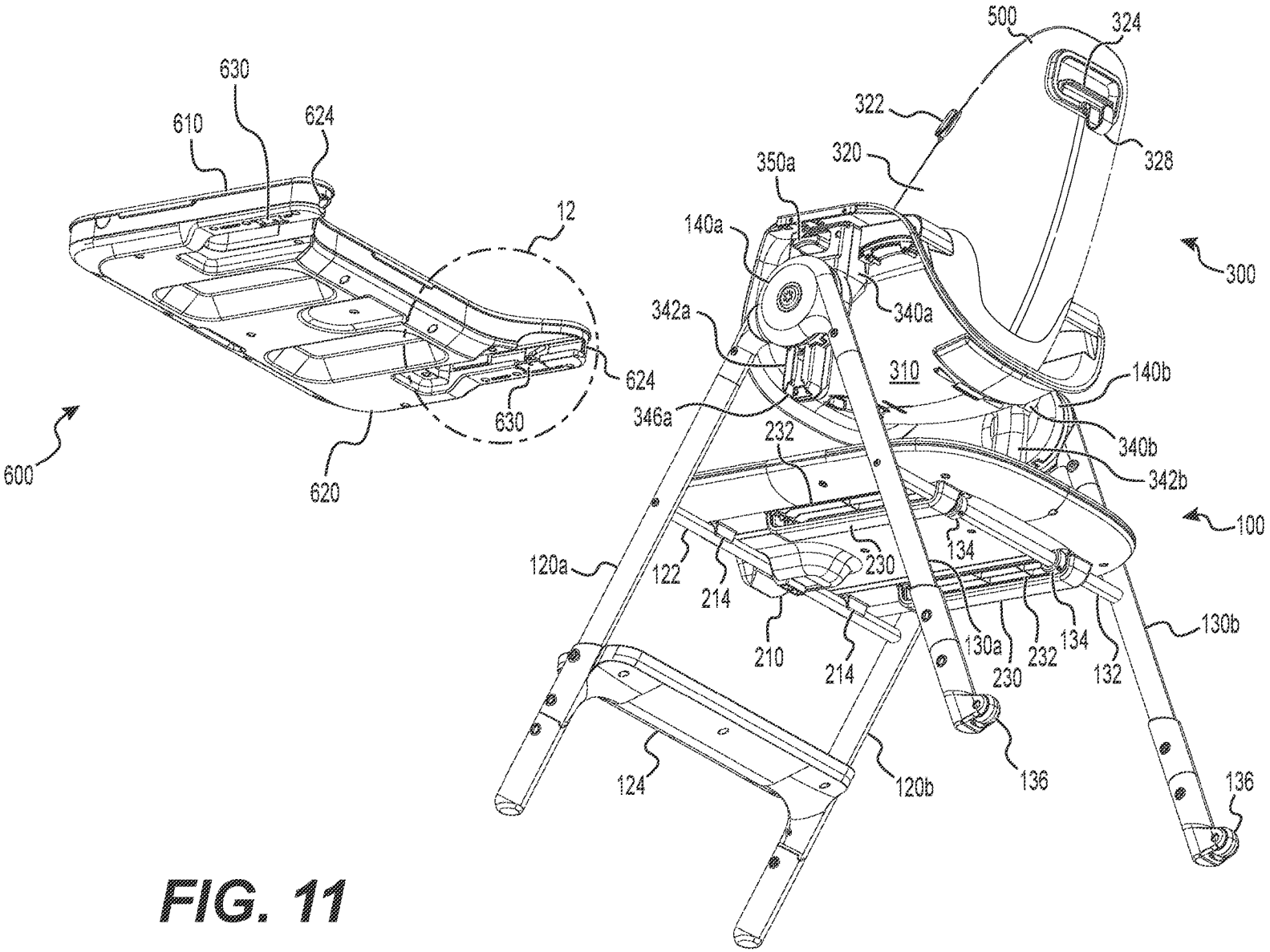
FIG. 11 is a lower rear perspective view of the high chair system in a high chair configuration, with the tray removed but still visible, in accordance with various embodiments of the present invention.

FIG. 11 is a lower rear perspective view of the system 1000 in a high chair configuration, with the tray 600 removed but still visible, in accordance with various embodiments of the present invention. As shown, the rear side of the back 320 of the seat 300 includes a hook 328. The hook 328 may be made of a soft plastic such that it permits light articles such as bibs, towels, etc., to hang from the hook 328 while ensuring that heavier objects cannot tip the highchair (e.g., because the hook will bend and release the heavier objects).

In some embodiments, the back 320 of the chair 300 may tilt or recline relative to the seat 310. To that end, the chair 300 may include a latch 324 at the top of the back 320, which, when lifted, permits the back 320 to pivot relative to the seat 310 (e.g., by pulling a cable which in turn disengages a locking mechanism).

Figure 12B:
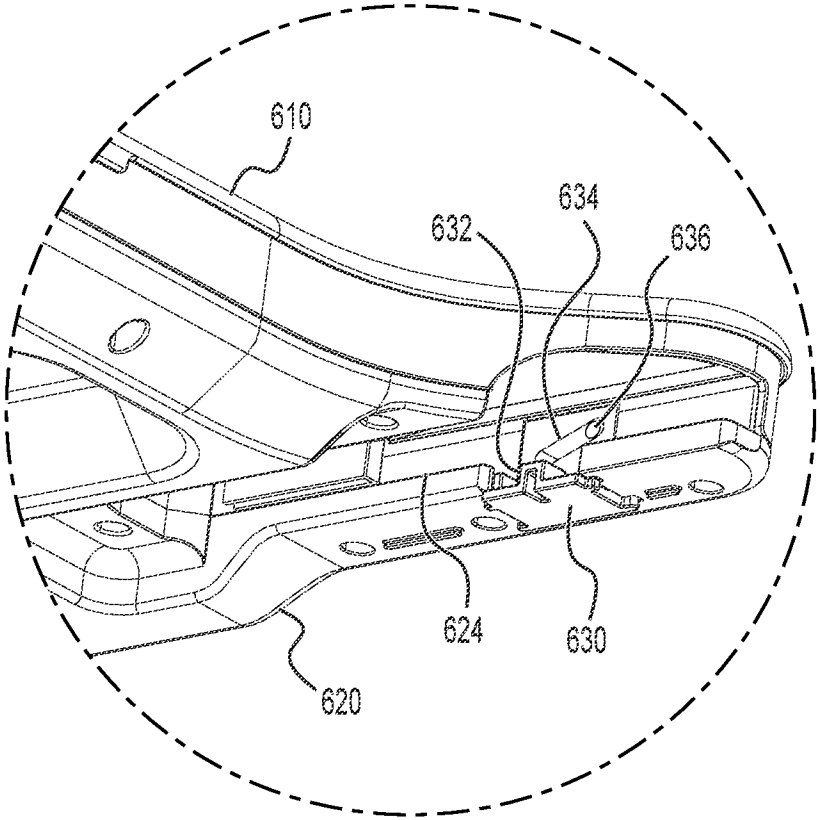
FIG. 12B shows the locking mechanism of the tray in an unlocked position, in accordance with various embodiments of the present invention.
Figure 12A:
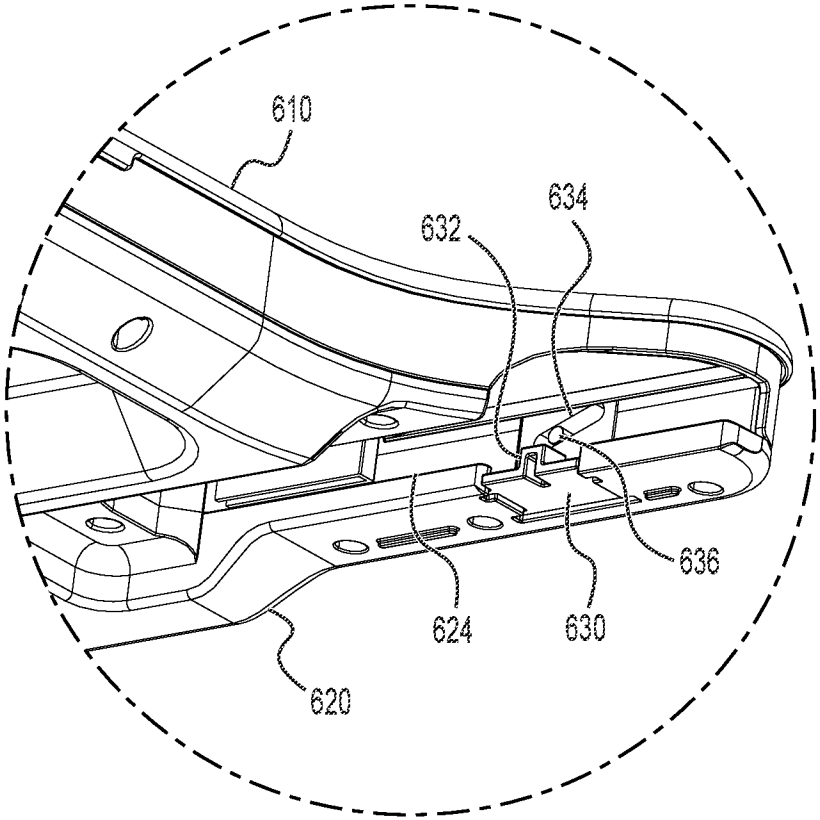
FIG. 12A shows the locking mechanism of the tray in a locked position, in accordance with various embodiments of the present invention.

As shown in FIG. 11, the lower portion 620 of the tray 600 includes channels 624 that mount to rails on either side of the seat 310 of the chair 300. FIGS. 12A and 12B show in detail the locking mechanism for the tray 600 indicated by dashed circle 12 in FIG. 11, in accordance with various embodiments of the present invention. FIG. 12A shows the locking mechanism in the locked configuration in which the catch 632 of the latch engages a notch located on the rail of the seat 210. Upon pressing a button 622 at the front of the tray 600 (shown in FIG. 2), the locking mechanism is changed to the unlocked position, as shown in FIG. 12B. Specifically, when the button 622 is pressed, an internal rod 636 is pushed backward. The end of the rod 636 is within an angled channel 634 defined in the latch 630. As such, when the rod 636 is pushed backward, the latch 630, and thus the catch 632, are pushed downward, releasing the tray 400 from the rails on the seat 210 of the chair 200.

Thus, various embodiments provide for a convertible high chair system that may be converted from a high chair to a step stool. The high chair may further be reclinable. As such, the high chair system can be used throughout a child's life, from an infant that is just starting to eat to a toddler to a school-aged child helping a parent in the kitchen. Such a system therefore is both versatile and provides a much longer lifecycle of usage.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A system for a combination high chair and step stool, comprising:

a base comprising:
- a first pair of legs;
- a first hinge pivotally joining the first pair of legs and comprising a first bracket;
- a second pair of legs;
- a second hinge pivotally joining the second pair of legs and comprising a second bracket;
- a first step disposed at a first elevation between at least one of the first pair of legs and at least one of the second pair of legs; and
- a second step disposed at a second elevation between the at least one of the first pair of legs and the at least one of the second pair of legs;

a chair comprising:
- a seat;
- a back;
- a first mounting member disposed at a first side of the chair and configured to be selectively attached to the first bracket; and
- a second mounting member disposed at a second side of the chair and configured to be selectively attached to the second bracket; and a handrail comprising:
- a bar;
- a third mounting member disposed at a first end of the bar and configured to be selectively attached to the first bracket; and
- a fourth mounting member disposed at a second end of the bar and configured to be selectively attached to the second bracket, wherein the chair and the handrail are interchangeably attachable to the base.

2. A combination high chair and step stool, comprising:
a base comprising:
a first pair of legs;
a second pair of legs;
a first step disposed at a first elevation between at least one of the first pair of legs and at least one of the second pair of legs;
a second step disposed at a second elevation between the at least one of the first pair of legs and the at least one of the second pair of legs;
a first bracket portion;
a second bracket portion;
a first hinge pivotally joining the first pair of legs and comprising the first bracket portion; and
a second hinge pivotally joining the second pair of legs and comprising the second bracket portion; and
a seat comprising:
a first mounting member configured to be selectively attached to the first bracket portion; and
a second mounting member configured to be selectively attached to the second bracket portion.

3. The combination of claim 2, further comprising:
a handrail comprising:
a bar;
a third mounting member disposed at a first end of the bar and configured to be selectively attached to the first bracket portion; and
a fourth mounting member disposed at a second end of the bar and configured to be selectively attached to the second bracket portion.

4. The combination of claim 3, wherein:
the first bracket portion comprises a central guide;
the third mounting member comprises a vertical channel; and
the central guide is inserted into the vertical channel when the third mounting member is attached to the first bracket portion.

5. The combination of claim 4, wherein the third mounting member further comprises a flexible tab for selectively locking the third mounting member to the first bracket portion.

6. The combination of claim 3, wherein the bar comprises a horizontal portion disposed between two vertical portions.

7. The combination of claim 2,
wherein, when the combination is in a first configuration, the first pair of legs extend downward at a first angle relative to each other and the second pair of legs extend downward at the first angle relative to each other, and
wherein, when the combination is in a second configuration, the first pair of legs extend downward at a second angle relative to each other and the second pair of legs extend downward at the second angle, the second angle being less than the first angle.

8. The combination of claim 7, wherein the first and second pairs of legs each include a front leg and a rear leg, the combination further comprising:
a front cross bar extending between the front legs of the first and second pairs of legs; and
a rear cross bar extending between the rear legs of the first and second pairs of legs,
wherein the second step extends between and is supported by the front and rear cross bars when the combination is in the first configuration, and
wherein the second step is supported by the rear cross bar and not the front cross bar when the combination is in the second configuration.

9. The combination of claim 8, wherein the second step includes a button that, when depressed, disengages the second step from the front cross bar.

10. The combination of claim 8, wherein the second step comprises an elongate channel through which the rear cross bar passes and along which the rear cross bar is permitted to travel when the combination is in the second configuration.

11. The combination of claim 2, wherein the first hinge includes a button that, when depressed, allows the first pair of legs to pivot relative to each other, and wherein the button is biased outward so as to prevent rotation of the first pair or legs relative to each other.

12. The combination of claim 2, wherein the second elevation is higher than the first elevation, and the second step comprises a platform spanning at least between front legs of the first and second pairs of legs and rear legs of the first and second pairs of legs.

13. A combination high chair and step stool for supporting a child above a surface, comprising:
a step stool portion comprising:
a first step disposed at a first elevation relative to the surface and capable of supporting the child;
a second step disposed at a second elevation relative to the surface and capable of supporting the child; and
a bracket; and
a chair portion comprising:
a seat;
a back; and
a mounting member configured to be selectively and releasably attached to the bracket, wherein:
the bracket comprises a central guide, the mounting member comprises a vertical channel, and the central guide is inserted into the vertical channel when the mounting member is attached to the bracket; and
the central guide comprises a plurality of depressions disposed at varying positions on an outward face thereof, the mounting member includes a projection disposed within the vertical channel, and wherein the projection is configured to be selectively inserted into any one of the plurality of depressions while the mounting member is attached to the bracket to thereby lock the mounting member and the bracket together and to enable the height of the chair portion relative to the step stool portion to be adjusted.

14. The combination of claim 13, wherein the projection is retractable into the mounting member and out of the plurality of depressions to permit the mounting member to move relative to the bracket.

15. The combination of claim 14, wherein the mounting member comprises a button that, when depressed, causes the projection to retract into the mounting member.

16. The combination of claim 13, further comprising a tray that is selectively attachable to the chair portion.

* * * * *